US006943494B2

(12) United States Patent
Chiou et al.

(10) Patent No.: US 6,943,494 B2
(45) Date of Patent: Sep. 13, 2005

(54) FIELD EMITTING LUMINOUS DEVICE

(75) Inventors: Jeng-Maw Chiou, Hsinchu (TW); Jon-Lian Kwo, Hsinchu (TW); Kwan-Jon Chang, Hsinchu (TW); Shy-Wen Lai, Hsinchu (TW); Ai-Kang Li, Hsinchu (TW); Hong-Jen Lai, Hsinchu (TW)

(73) Assignee: Industrial Technology Research Institute/Material Research, Hsinchu (TW)

( * ) Notice: Subject to any disclaimer, the term of this patent is extended or adjusted under 35 U.S.C. 154(b) by 0 days.

(21) Appl. No.: 10/378,754

(22) Filed: Mar. 5, 2003

(65) Prior Publication Data

US 2004/0174109 A1 Sep. 9, 2004

(51) Int. Cl.[7] ..... H01J 29/46

(52) U.S. Cl. ..... 313/496; 313/103 CM; 313/105 CM; 313/306

(58) Field of Search ..... 313/495, 496, 313/103 R, 306, 310, 336, 351, 105 CM, 311, 105 R

(56) References Cited

U.S. PATENT DOCUMENTS 5,656,887 A * 8/1997 Voshell et al. ..... 313/496
5,751,109 A 5/1998 Payne
5,955,833 A * 9/1999 Janning ..... 313/495
5,982,082 A 11/1999 Janning

* cited by examiner

*Primary Examiner*—Ashok Patel
(74) *Attorney, Agent, or Firm*—Birch, Stewart, Kolasch & Birch, LLP

(57) ABSTRACT

A field emitting luminous device is disclosed. The device includes a cathode electron emitting unit, an electron amplifying unit, a panel unit, and an electric power supply unit. The primary electrons emitted from the cathode electron emitting unit hit the electron amplifying material on the electrode surface of the electron amplifying unit, generating amplified secondary electrons. The secondary electrons bombard the light-emitting layer of the panel unit, producing fluorescence. The fluorescence penetrates the upper transparent panel and is thus observed by eyes.

23 Claims, 5 Drawing Sheets

FIELD EMITTING LUMINOUS DEVICE

BACKGROUND OF THE INVENTION

1. Field of Invention

The invention relates to a field emitting luminous device for illumination.

2. Related Art

Scientists have developed various kinds of illuminating sources using the light-emitting principles of different materials. As it is seen now, the illuminating devices have very close relations with all businesses. They have wide applications in aviation, navigation, land transportation, industries, national defense, health care, and daily life.

After the field emitting luminous mechanism was disclosed by Laboratorie d'Electronique de Technologieet d'Instrumentation (LETI) in the fourth International Vacuum Microelectronics conference, it has received very much attention from illuminator manufacturers all over the world. Its light emission principle is the same as the cathode ray tube (CRT). By bombarding electrons on a fluorescent material coated on a glass surface, the fluorescent material produces fluorescence. The advantages of the field emitting illumination are: a longer lifetime, energy-efficient, a light and thin structure, and a wide color temperature range.

The products using the field emitting illuminating mechanism are mainly the field emitting displays. The light-emitting mechanism and structure of the field emitting luminous device are very similar to those of the field emitting displays. The only difference is that each light-emitting unit (pixel) of the field emitting display has to be very small. That is, the pixels of different (or same) colors have to be so small and disposed together that they can provide the function of a display. For the field emitting luminous device, only a light-emitting layer (fluorescent powders) is required for producing light. Therefore, one can apply the structure of the field emitting display to the field emitting luminous device for making a long-lifetime and energy-efficient illuminating device.

Currently, electron amplifying devices for displays have been built. The main idea is to amplify the electrons emitted from the field emitting display by a larger factor (100~1000) using the electron amplifying device. This helps increasing the intensity of light emitted by the field emitting display.

Please refer to FIG. 1 for the field emitting display disclosed in the U.S. Pat. No. 5,982,082. The display device is comprised of a transparent panel 38, an electrode 42, a first barrier 54, a fluorescent material 40, a separator 44, a second barrier 52, an electron amplifying layer 50, an electrode 46, space 51, and a cathode electron emitting unit 36.

The electrons 33 emitted from the cathode electron emitting unit 36 spread out in the space 51. Afterwards, the electrons 33 hit the electron amplifying layer 50 and collide with other electrons in the electron amplifying layer 50, producing secondary electrons. The secondary electrons then bombard the fluorescent material 40 to produce fluorescence, which penetrates through the panel 38 and becomes a beam 31 traveling outward.

There is only one electron amplifying layer 50 in the field emitting display device. Therefore, its amplifying effect is limited. Moreover, the space 51 has to be enclosed by separating devices. The space is thus susceptible to pressures and has a complicated structure. Consequently, it is not suitable for large-size displays.

The segmented cold cathode display panel disclosed in the U.S. Pat. No. 5,751,109 is schematically shown in FIG. 2. The electron amplifying structure is a channel plate 33, which contains an outgoing surface 62 and an incoming surface 60. The potential of the outgoing surface 62 is higher than that of the incoming surface 60 by about 1000V. In other words, the channel plate 33 is a resistor plate and the channel 41 has a potential gradient. Through the potential gradient, the electrons can be accelerated in the channel 41 and collide to produce secondary electrons.

However, the drawback of this method is that even when no electrons pass by, there is a very large potential difference between the outgoing surface 62 and the incoming surface 60 due to the existence of a finite resistance on the channel plate 33. This produces a static power consumption, $P=V^2/R$. Moreover, such an electron amplifying structure is not feasible in products that require high precisions.

SUMMARY OF THE INVENTION

In view of the foregoing, an objective of the invention is to provide a field emitting luminous device that utilizes an electron amplifying material to achieve secondary or even multiple electron amplifying effects. Using several layers of electrodes with the electron amplifying material, a bigger electron amplifying factor can be obtained.

The disclosed field emitting luminous device is made of three major parts: a cathode electron emitting unit, an electron amplifying unit, and a panel unit. The cathode electron emitting unit provides electrons needed by the light-emitting mechanism in the field emitting luminous device. Through a potential difference imposed on the electrode in the cathode electron emitting unit and the electrode in the panel unit, the electrons are attracted to accelerate and move toward the panel unit.

During its motion, the electron will hit the electron amplifying material in the electron amplifying unit, thereby amplifying the electrons. The secondary electrons generated by the bombardment of the electrons are further attracted and accelerated by the above-mentioned potential difference. Finally, they hit the fluorescent material in the panel unit to produce fluorescence. The fluorescence penetrates through the top panel and is observed by eyes.

In addition to the electron amplifying function, the electron amplifying unit also has the effect of supporting the space structure of the luminous device, making it more sturdy and stable.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
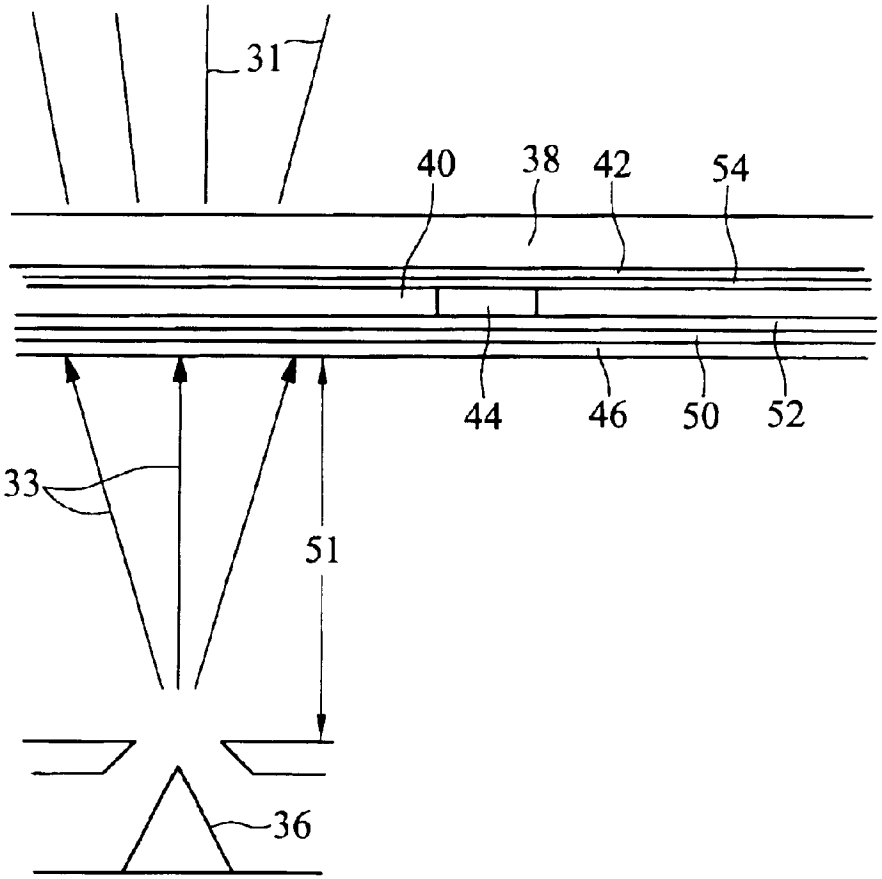
FIG. 1 (PRIOR ART)
FIG. 1 is a schematic view of the structure of a conventional field emitting display device.
Figure 2:
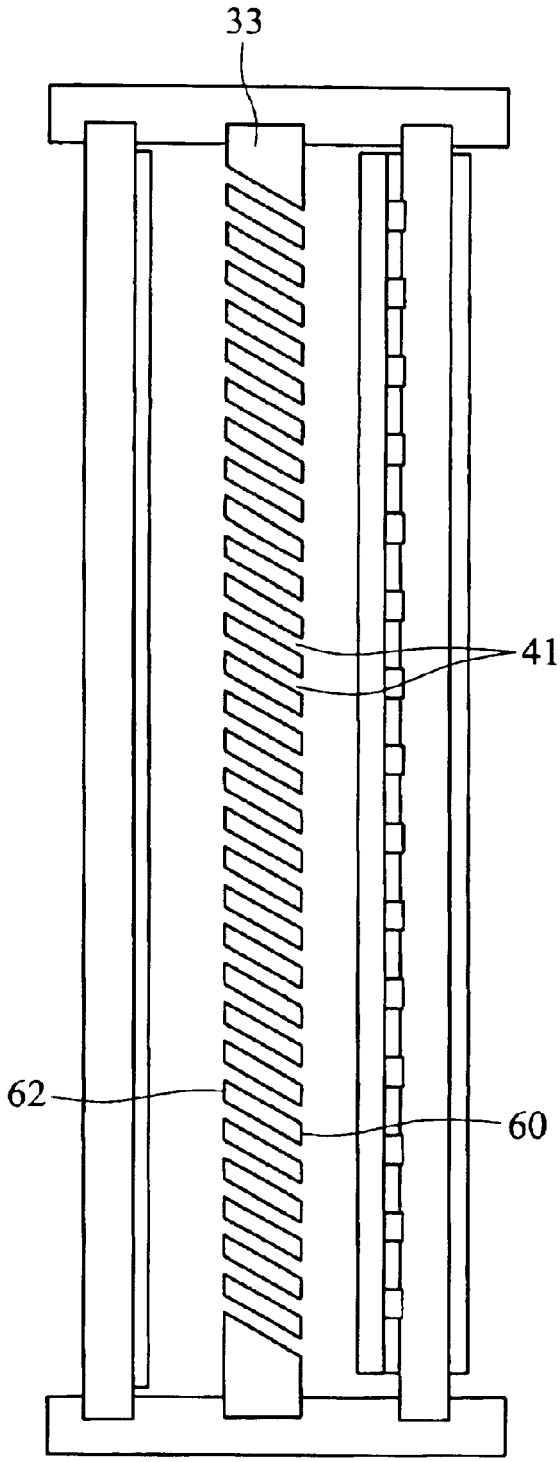
FIG. 2(PRIOR ART)
FIG. 2 is a schematic view of the structure of a segmented cold cathode display panel in the prior art.
Figure 3:
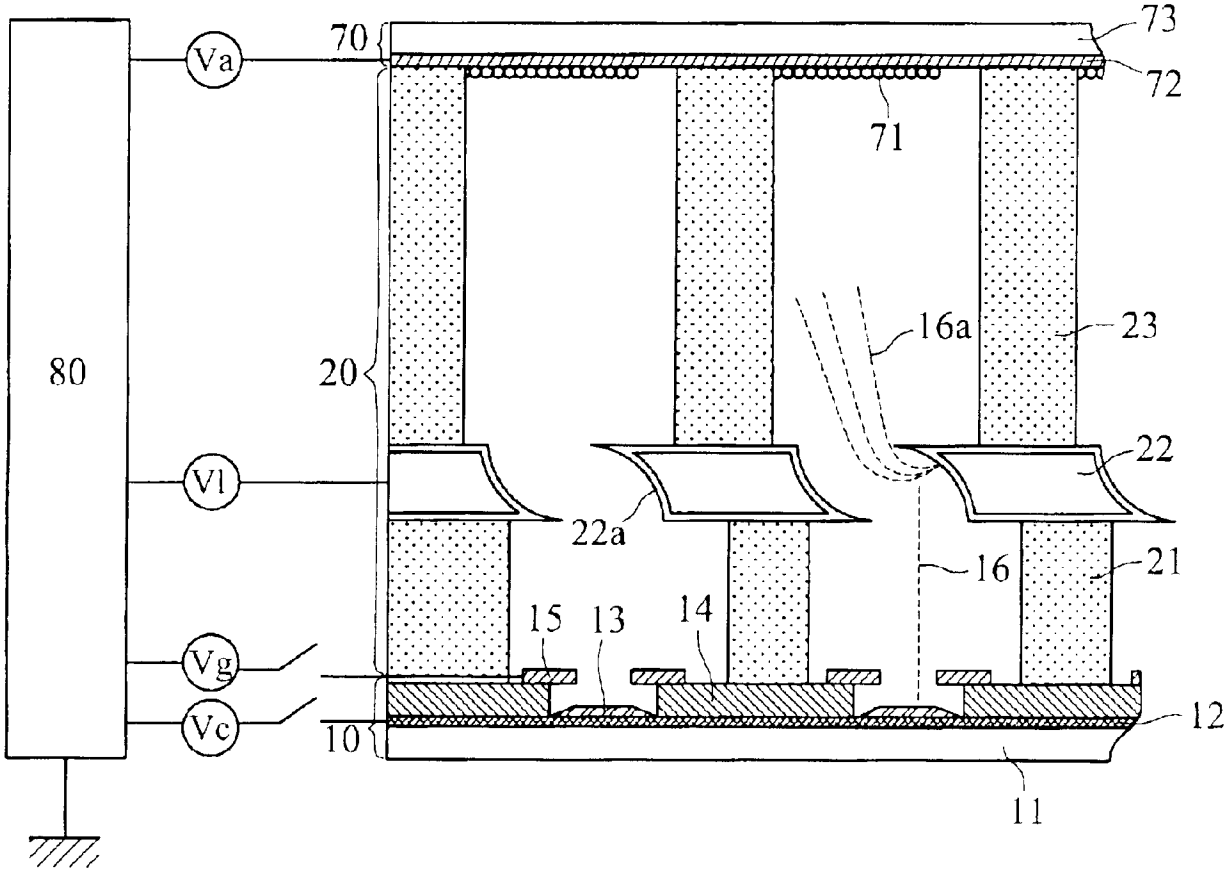
FIG. 3 is a side view of the structure in the first embodiment of the invention.

A first embodiment of the disclosed field emitting luminous device is shown in FIG. 3. As seen from its side, it contains a cathode electron emitting unit 10, an electron amplifying unit 20, and a panel unit 70.

The cathode electron emitting unit 10 provides electrons needed by the light-emitting mechanism in the field emitting luminous device. Through a potential difference imposed on the electrode in the cathode electron emitting unit 10 and the electrode in the panel unit 70, the electrons are attracted to accelerate and move toward the panel unit 70.

During its motion, the electron will hit the electron amplifying material in the electron amplifying unit 20, thereby amplifying the electrons. For example, an electron emitted by the cathode electron emitting unit 10 will produce two electrons after hitting the electron amplifying material. The secondary electrons generated by the bombardment of the electrons are further attracted and accelerated by the above-mentioned potential difference. Finally, they hit the fluorescent material in the panel unit 70 to produce fluorescence. The fluorescence penetrates through the top panel and is observed by eyes.

The cathode electron emitting unit 10 at the bottom of the whole field emitting luminous device includes a substrate 11, a first electrode 12, cathode electron emission parts 13, a first insulator layer 14, and a second electrode (gate) 15. The first electrode 12 is coated on the substrate 11. Several cathode electron emission parts 13 are installed at appropriate positions on the first electrode 12. Each of the cathode electron emission parts 13 is made of a cathode electron emission material for providing the electrons needed by the light-emitting mechanism of the field emitting luminous device.

The first insulator layer 14 actually consists of several insulators. The insulators and the cathode electron emission parts 13 are installed at intervals. Each insulator is installed with a second electrode (gate) 15. The first insulator layer 14 provides the electrical insulation between the first electrode 12 and the second electrode (gate) 15. By tuning the potential difference between the first electrode 12 and the second electrode (gate) 15, each cathode electron emission part 13 can be controlled to emit primary electrons 16 at a designated time.

In addition to the structure shown in FIG. 3, the cathode electron emitting unit 10 can be replaced by other kinds of cathode electron emitting units 10, such as a point emitter, a wedge emitter, a thin-film amorphic diamond emitter, a thin film edge emitter, a surface emitter, an edge emitter, or an carbon nanotube emitter.

The main function of the electron amplifying unit 20 is to generate the secondary electron amplification for the electrons emitted from the cathode electron emitting unit 10. Its structure includes a second insulator layer 21, a first electron amplifying electrode 22, and a third insulator layer 23. The second insulator layer 21 can be individual insulating pillars or a continuous tube wall installed above the first insulator layer 14.

The first electron amplifying electrode 22 is installed on top of the second insulator layer 21. The first electron amplifying electrode 22 is also imposed with a voltage to produce a potential difference with respect to the first electrode 12. Therefore, the primary electrons 16 are attracted to move toward the first electron amplifying electrode 22.

The first electron amplifying electrode 22 is a thin metal plate, formed with several skewed-wall through holes 22*a*. The surface of the first electron amplifying electrode 22 is coated with an electron amplifying material. The design of the skewed-wall through holes 22*a* is to enable the primary electrons 16 to effectively bombard the electron amplifying material on the surface of the first electron amplifying electrode 22 for producing secondary electrons 16*a*.

Figure 4:
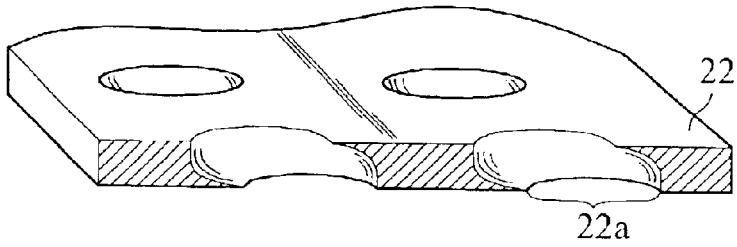
FIG. 4 is the cross-sectional view of a flatly-skewed-wall through hole.
Figure 5:
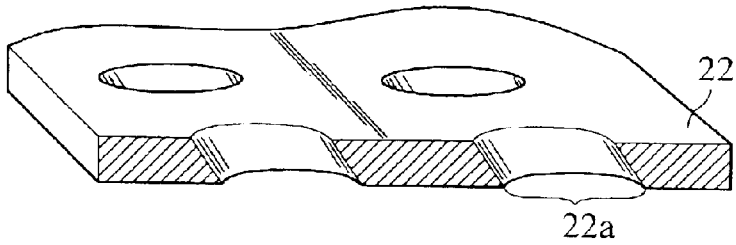
FIG. 5 is the cross-sectional view of a vertical through hole.
Figure 6:
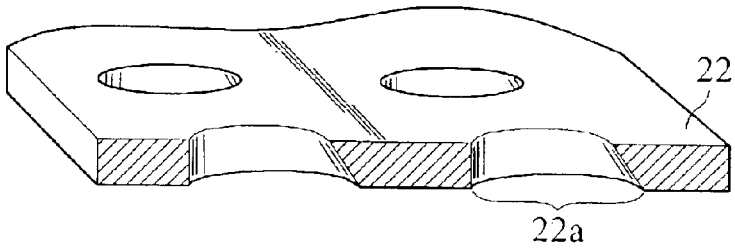
FIG. 6 is the cross-sectional view of combined vertical and flatly-skewed-wall through holes.

The wall of the through hole 22*a* can be the concavely skewed one shown in FIG. 3, the flatly skewed one shown in FIG. 4, the vertical one shown in FIG. 5, the combination of vertical and flatly skewed shown in FIG. 6, or any combination of the concavely skewed, flatly skewed, and vertical. According to different needs, one can even have convexly skewed through holes or other regular and irregular ones.

The electron amplifying material on the surface of the primary electron amplifying electrode 22 can be alloys, such as AuMg, CuBe, CuBa, AuBa, AuCa, WBaAu alloys, oxides of Be, Mg, Ca, Sr, Ba, other metal oxides with high multiplying factors, and other chemical compounds.

The third insulator layer 23 is installed on top of the first electron amplifying electrode 22. The third insulator layer 23 can also be individual pillars or a continuous tube wall installed on the first electron amplifying electrode 22. The whole electron amplifying unit 20 is formed using solid materials (the second insulator layer 21, the first electron amplifying electrode 22 and the third insulator layer 23). Therefore, its does not only have the function of amplifying electrons, but also enhance the spatial support of the structure.

The panel unit 70 at the top of the whole field emitting luminous device contains: a light-emitting layer 71, an upper electrode 72, and a transparent panel 73. The upper electrode 72 is made of transparent conductive materials such as an indium tin oxide (ITO). The lower surface of the upper electrode 72 has a light-emitting layer 71 made of a fluorescent material.

The top of the upper electrode 72 is installed with the transparent panel 73 made of glass or other transparent materials. When the secondary electrons 16*a* hit the light-emitting layer 71, they interact with the fluorescent material and produce fluorescence. The fluorescent light thus generated penetrates through the transparent panel 73 to the exterior.

The electric power supply unit 80, shown in FIG. 3, is to provide the required voltages and currents for the operation of the device.

The labels Va, V1, Vg, and Vc in FIG. 3 are the voltage imposed on the upper electrode 72, the first electron amplifying electrode 22, the second electrode 15, and the first electrode 12, respectively.

Figure 7:
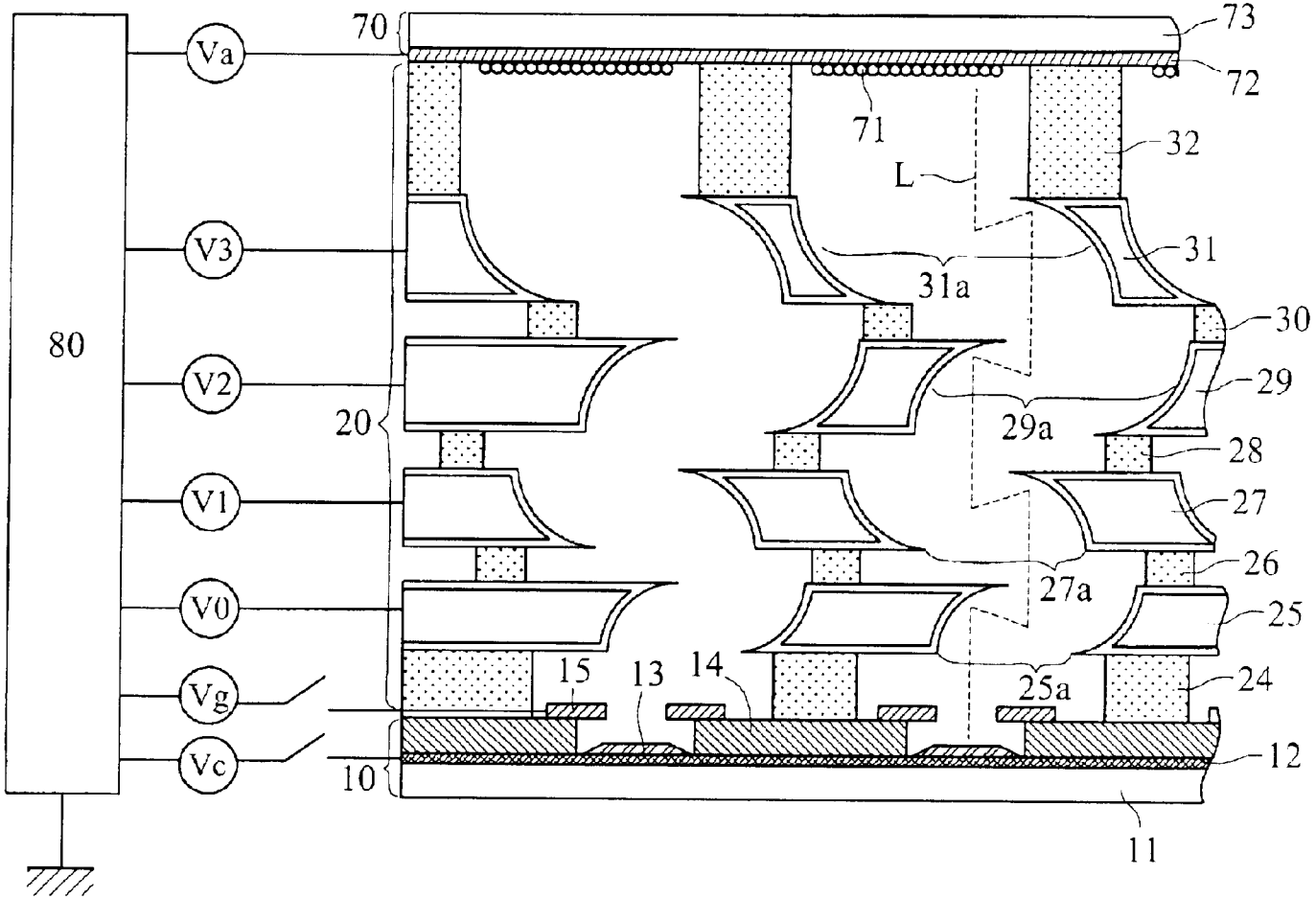
FIG. 7 is a side view of the structure in the second embodiment of the invention.

A second embodiment of the invention is shown in FIG. 7. Its structure is roughly the same as the first embodiment.

However, its electrode amplifying unit 20 is formed by stacking several layers of electron amplifying electrodes and insulating materials. The primary electrons 16 emitted by the cathode electron emitting unit 10 are amplified by the multi-layer electron amplifying material to effectively amplifying the weaker primary electron signal, thereby providing an illuminating device with a larger multiplying factor.

The electron amplifying unit 20 contains: a fourth insulator layer 24, a second electron amplifying electrode 25, a fifth insulator layer 26, a third electron amplifying electrode 27, a sixth insulator layer 28, a fourth electron amplifying electrode 29, a seventh insulator layer 30, a fifth electron amplifying electrode 31, and an eighth insulator layer 32. The fourth insulator layer 24, the fifth insulator layer 26, the sixth insulator layer 28, the seventh insulator layer 30, and the eighth insulator layer 32 may be individual insulating pillars or a continuous tube wall installed between each two adjacent electrodes. These insulator layers make each electrode equipotential. The second electron amplifying electrode 25, the third electron amplifying electrode 27, the fourth electron amplifying electrode 29, and the fifth electron amplifying electrode 31 are thin metal plates. Each electrode is formed with several skewed-wall through holes 25*a*, 27*a*, 29*a*, 31*a*. The surface of each electrode is coated with an electron amplifying material.

To effectively amplifying the electron signal, the skewed-wall through holes 25*a*, 27*a*, 29*a*, 31*a* on the electrodes should be properly configured to have different sizes and shapes. From FIG. 7, we see that the through hole 31*a* in the fifth electron amplifying electrode 31 is the largest, the through hole 29*a* in the fourth electron amplifying electrode 29 is the second largest, the through hole 27*a* in the third electron amplifying electrode 27 is the third, and the through hole 25*a* in the second electron amplifying electrode 25 is the smallest.

In the electron amplifying unit 20, the positions of the through hole 31*a* in the top electrode (the fifth electron amplifying electrode 31) and the through hole 25*a* in the bottom electrode (the second electron amplifying electrode 25) cannot be overlapped so as to prevent positive ions from going backwards. This simultaneously avoids the anode material or fluorescent material from depositing on the electron emission part 13 or the second electrode 15, which will shorten the product lifetime.

Influenced by the potential difference between each two electrode layers, the primary electrons 16 emitted from the cathode electron emitting unit 10 move toward the panel unit 70. The amplification path of the electrons is shown by the line L. When the primary electrons 16 hit the electron amplifying material on the surface of the second electron amplifying electrode 25, the secondary electrons are produced. When the secondary electrons hit the third electron amplifying electrode 27, third-order electrons are produced. When the third-order electrons hit the fourth electron amplifying electrode 29, fourth-order electrons are produced. When the fourth-order electrons hit the fifth electron amplifying electrode 31, fifth-order electrons are produced. The fifth-order electrons hit the fluorescent material on the light-emitting layer 71. The fluorescence thus produced penetrates through the transparent panel 73 and is observed by eyes.

The electric power supply unit 80, shown in FIG. 7, is to provide the required voltages and currents for the operation of the device.

The labels Va, V3, V2, V1, V0, Vg, and Vc in FIG. 7 are the voltage needed for the upper electrode 72, the fifth electron amplifying electrode 31, the fourth electron amplifying electrode 29, the third electron amplifying electrode 27, the second electron amplifying electrode 25, the second electrode 15, and the first electrode 12.

In the first and second embodiments, we only use the secondary electron amplification and the fifth-order electron amplification as examples. However, one may increase or reduce the number of electrodes with the electron amplifying material according to practical needs.

The disclosed field emitting luminous device can be used for indoor illumination, outdoor illumination, projection illumination, LCD backlit panel, plane illumination, etc. It can contain several layers of electrodes with electron amplifying effects. Therefore, it provides a highly bright luminous device that can amplify weak signals.

Certain variations would be apparent to those skilled in the art, which variations are considered within the spirit and scope of the claimed invention.

What is claimed is:

1. A field emitting luminous device comprising:

a cathode electron emitting unit, which emits a plurality of primary electrons;

an electron amplifying unit, which is installed on top of the cathode electron emitting unit for amplifying the primary electrons and supporting the field emitting luminous device;

wherein the electron amplifying unit contains:

a plurality of insulator layers and a plurality of electrode layers, the plurality of insulator layers sandwiching the plurality of electrode layers, each of the plurality of electrode layers being a thin metal plate with a plurality of through holes and sandwiched between two of the plurality of insulator layers, the surface of each of the plurality of electrode layers having an electrode amplifying material, and the two of the plurality of insulator layers providing electrical insulation;

a panel unit, which contains:

an upper electrode layer, which is made of a transparent conductive material and is installed on top of the electron amplifying unit and has a light-emitting layer on its bottom surface; and a transparent panel, which is installed on top of the upper electrode layer; and an electric power supply unit, which provides the required voltages and currents for the operation of the device;

wherein the primary electrons are attracted by a potential imposed on the cathode electron emitting unit, the electrode layer, and the upper electrode layer to move toward the panel unit, the primary electrons hit the electron amplifying material on the surface of the electrode layer to produce secondary electrons, and the secondary electrons travel through the through holes and hit the light-emitting layer, producing fluorescence penetrating through the transparent panel, the sizes of the plurality of through holes on the plurality of electrode layers become larger as on goes from the cathode electron emitting unit toward the panel.

2. The field emitting luminous device of claim 1, wherein the cathode electron emitting unit further comprises:

a substrate;

a first electrode installed on the substrate;

a plurality of cathode electron emission parts installed on appropriate positions on the first electrode for emitting the primary electrons;

a first insulator layer, which is comprised of a plurality of insulators, each of the insulators being separated from the cathode electron emission parts for providing electrical insulation; and a plurality of second electrodes installed on top of the insulators;

wherein the cathode electron emission parts are controlled to emit the primary electrons at a designated time by tuning the potentials imposed on the first electrode and the second electrodes.

3. The field emitting luminous device of claim 2, wherein the cathode electron emission parts are made of a cathode electron emitting material.

4. The field emitting luminous device of claim 1, wherein the cathode electron emitting unit is selected from the group consisting of a point emitter, a wedge emitter, a thin-film amorphic diamond emitter, a thin film edge emitter, a surface emitter, an edge emitter, and an carbon nanotube emitter.

5. The field emitting luminous device of claim 1, wherein the two insulator layers are comprised of a plurality of insulating pillars.

6. The field emitting luminous device of claim 1, wherein the two insulator layers are comprised of a plurality of continuous tube walls.

7. The field emitting luminous device of claim 1, wherein the wall of the through holes are selected from the group consisting of a free concavely skewed surface, a flatly skewed surface, a vertical surface, and a convexly skewed surface.

8. The field emitting luminous device of claim 1, wherein the cross section of the through holes has one side as a concavely skewed surface and the other side as a flatly skewed surface.

9. The field emitting luminous device of claim 1, wherein the cross section of the through holes has one side as a concavely skewed surface and the other side as a vertical surface.

10. The field emitting luminous device of claim 1, wherein the cross section of the through holes has one side as a concavely skewed surface and the other side as a convexly skewed surface.

11. The field emitting luminous device of claim 1, wherein the cross section of the through holes has one side as a flatly skewed surface and the other side as a vertical surface.

12. The field emitting luminous device of claim 1, wherein the cross section of the through holes has one side as a flatly skewed surface and the other side as a convexly skewed surface.

13. The field emitting luminous device of claim 1, wherein the cross section of the through holes has one side as a vertical surface and the other side as a convexly skewed surface.

14. The field emitting luminous device of claim 1, wherein the electron amplifying material is selected from the group consisting of AgMg, CuBe, CuBa, AuBa, AuCa, and WBaAu alloys.

15. The field emitting luminous device of claim 1, wherein the electron amplifying 5 material is selected from the group consisting of oxides of Be, Mg, Ca, Sr, Ba.

16. The field emitting luminous device of claim 1, wherein the upper electrode layer is selected from the group consisting of an indium tin oxide (ITO) and transparent conducting oxides.

17. The field emitting luminous device of claim 1, wherein the light-emitting layer is a 10 fluorescent material.

18. The field emitting luminous device of claim 1, wherein the transparent panel is made of glass.

19. The field emitting luminous device of claim 1, wherein the transparent panel is made of transparent plastics.

20. The field emitting luminous device of claim 1, wherein the trough holes on the top and bottom layers do not overlap with each other.

21. The field emitting luminous device of claim 1, wherein the transparent panel extends in a first direction and wherein the surface of one of the plurality electrode layers of the electron amplifying unit hit by the primary electrons is non-perpendicular to the first direction.

22. The field emitting luminous device of claim 1, wherein the primary electrons travel from the cathode electron emitting unit in a travel direction and wherein an opening is provided between the second electrodes above the electron emission parts, sidewalls of the openings of the second electrodes being parallel to the travel direction.

23. The field emitting luminous device of claim 1, wherein an opening is provided between the second electrodes above the electron emission parts, sidewalls of the openings of the second electrodes being perpendicular to the transparent panel of the panel unit.

* * * * *